US005388364A

United States Patent [19]

Paldino

[11] Patent Number: 5,388,364

[45] Date of Patent: Feb. 14, 1995

[54] INTERNALLY MOUNTED LASER GUNSIGHT

[76] Inventor: Arthur Paldino, 470 Halstead Ave., Harrison, N.Y. 10528

[21] Appl. No.: 76,419

[22] Filed: Jun. 14, 1993

[51] Int. Cl.[6] ..... F41G 1/34

[52] U.S. Cl. ..... 42/103; 362/114

[58] Field of Search ..... 42/103; 33/241; 362/110, 113, 114

[56] References Cited

U.S. PATENT DOCUMENTS

| | | | |
|---|---|---|---|
| 1,149,705 | 8/1915 | Ward | 42/103 |
| 3,995,376 | 12/1976 | Kimble | 35/25 |
| 4,161,076 | 7/1979 | Snyder | 42/103 |
| 4,313,273 | 2/1982 | Matthews | 42/103 |
| 4,777,754 | 10/1988 | Reynolds | 42/103 |
| 4,843,336 | 6/1989 | Kuo | 362/110 |
| 4,934,086 | 6/1990 | Houde-Walter | 362/110 |
| 4,939,863 | 7/1990 | Alexander | 42/103 |
| 5,042,186 | 8/1991 | Bechtel | 42/103 |
| 5,056,254 | 10/1991 | Bechtel | 42/103 |
| 5,068,969 | 12/1991 | Siebert | 33/241 |
| 5,107,612 | 4/1992 | Bechtel | 42/103 |
| 5,119,576 | 6/1992 | Bechtel | 42/103 |

FOREIGN PATENT DOCUMENTS

| | | | |
|---|---|---|---|
| 694560 | 12/1930 | France | 42/103 |
| 3546295 | 7/1987 | Germany | 42/103 |

OTHER PUBLICATIONS

Guns & Ammo Sep. 1992 p. 36.

Tasco Sales Inc-What's New-Laserpoint-Advertisement-Article on Magazine Page-Magazine & Date Not Known.

*Primary Examiner*—Stephen M. Johnson

*Attorney, Agent, or Firm*—Martin J. Spellman, Jr.

[57] ABSTRACT

A laser gunsight for semiautomatic hand guns is disclosed. The laser circuitry, diode and lens are contained in a cylindrical shaft which replaces the usual recoil spring guide. Electrical power for the sight is supplied from either of two pairs of batteries mounted in plastic panels in the gun handle. Current is carried through conductive strips embedded in the plastic panels, The slide return and cross bar which are electrically insulated from the gun frame, and an electrically insulated longitudinal pin in the cylindrical shaft. An on-off push button switch on one side of the handle makes or breaks contact with the conductive strips in the plastic panel. The circuit is completed through the gun frame and magazine which is in conductive contact with the batteries when the magazine is mounted in the gun. When the magazine is removed for loading, the circuit is interrupted, which in combat situations serves to assure that the laser is not inadvertently activated and the user's location revealed.

3 Claims, 9 Drawing Sheets

INTERNALLY MOUNTED LASER GUNSIGHT

BACKGROUND OF THE INVENTION

1. Field of the Invention

The present invention relates to improved laser sight equipped semi automatic hand guns.

Laser sights have been used with hand guns for some time including revolvers and semi-automatic types of handguns. In most cases, the laser sight including the laser emitting source and supporting circuitry and power source has been added as a package attachment to the gun and results in a relatively bulky and awkwardly handling weapon.

Such externally mounted sights are subjected to shocks and pressures which often cause misalignment of the sight with the barrel of the gun. In addition, they require custom made holsters.

The present invention is directed to a semi-automatic handgun having a laser sight which is entirely within the gun. This is accomplished by replacing the recoil spring guide under the barrel of the weapon with the laser beam emitting portion of the laser sight apparatus and placing battery power sources and switching means contained within the interior of the handle of the weapon. The power circuit from the battery(s) source to the light emitting diode is comprised of a unique electric conduit through connecting parts of the gun with the ground portion of the circuit being completed through the basic frame of the weapon. In addition, the laser circuit is automatically turned off when the magazine is removed for reloading to assure that in a combative situation the laser beam does not permit inadvertent revelation of the user's location.

The laser aimed semi-automatic hand gun according to the present invention is compact, relatively simple in structure and uncomplicated in its use, particularly compared to existing laser sights on semi-automatic hand guns.

2. Prior Art

U.S. Pat. No. 4,934,086 Houde-Water, discloses a semi-automatic hand gun having a laser sight added to or in place of the recoil spring guide wherein the light emitting diode may be remote from the spring guide and connected to a collimating lens at the front or rear of the rod, in the case of the glass rod, or in combination with a reflector. Various grips, trigger switches and gravity switches are utilized. This design requires circuit wires being connected and running through the gun and a number of additional switches.

Interiorly mounted laser sights or related type of sights are disclosed in U.S. Pat. No. 3,995,376 Kimball et al, wherein the laser is used in conjunction with a detector unit on a training target to trigger an audible sound when the weapon is aimed and fired at as practice target. U.S. Pat. No. 3,995,376, Kimble et al—discloses a laser design for adding to a weapon and for operating in conjunction with a detector unit on a target to trigger an audible sound when the weapon is properly aimed at the target.

U.S. Pat. No. 4,161,076, Snyder describes a add on laser for an automatic weapon.

Add on laser sights are shown in the following patents;

U.S. Pat. No. 4,313,273, Matthews et al, is another add on type as are those U.S. Pat. No. 4,777,754, Reynolds, Jr.; U.S. Pat. No. 4,939,863, Alexander et al.; U.S. Pat. No. 5,042,186, Bechtel; U.S. Pat. No. 5,056,254, Bechtel; U.S. Pat. No. 5,119,576, Erning.

SUMMARY OF THE INVENTION

The present invention provides completely internally mounted laser sight for semi-automatic handguns. The semi-automatic handgun is characterized by the utilization of recoil spring that is compressed by the recoil action of the barrel when the gun is fired. As the spring thereafter expands, it drives the barrel and breach block forward with a fresh round in the chamber, readying the pistol to fire again.

The present invention is applicable to those semi automatics where the spring guide is partially exposed at the front of the frame. In all cases, the spring guide is fixed or secured to the pistol frame so it does not move when the slide barrel and the breach lock move in response to firing a round.

A cylindrical structure containing a laser sight comprising a lens, light emitting diode, and circuitry boards replaces the usual recoil spring guide. It is joined by a unique means of connecting circuitry to a remote power source in the handle of the weapon. The unique circuitry system is built in integrally with the conventional parts of the weapon. The ground segment of the circuit is completed through the frame of the weapon.

Alternate battery power systems are provided and a simple on/off switch for the system provided in the handle.

In the preferred embodiment, the operating circuit is automatically disabled when the magazine is removed. This is an important feature so as to avoid the possibility of the laser beam being visible during reloading and giving away the user's location during combat situations.

ILLUSTRATIVE SPECIFIC EMBODIMENT

Figure 1:
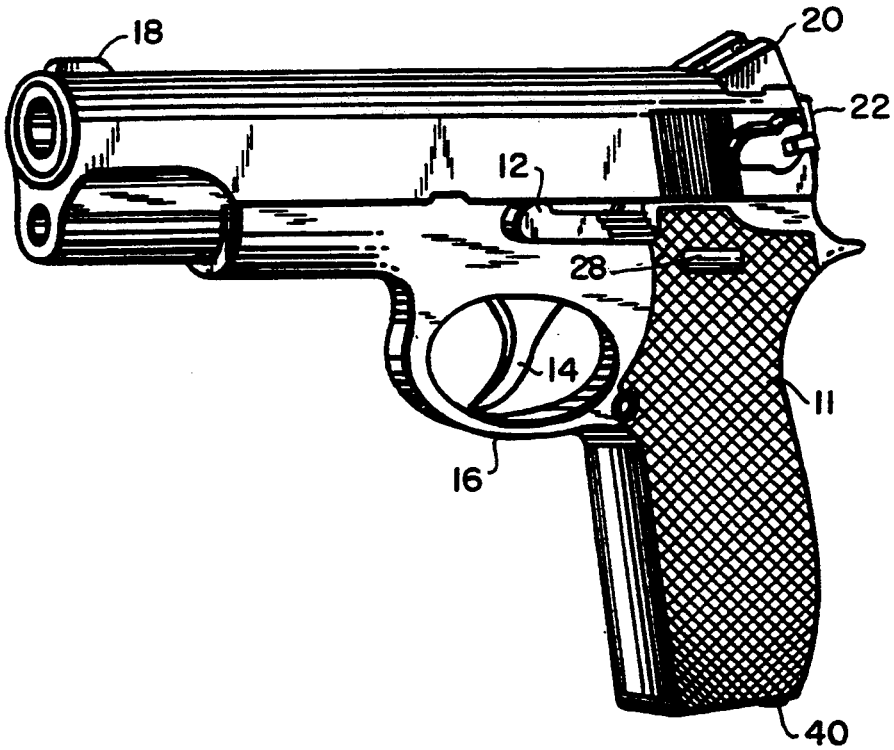
FIG. 1 is a perspective view front the front left quarter of a colt 45 semi-automatic hand gun incorporating the laser sight of the present invention.
Figure 2:
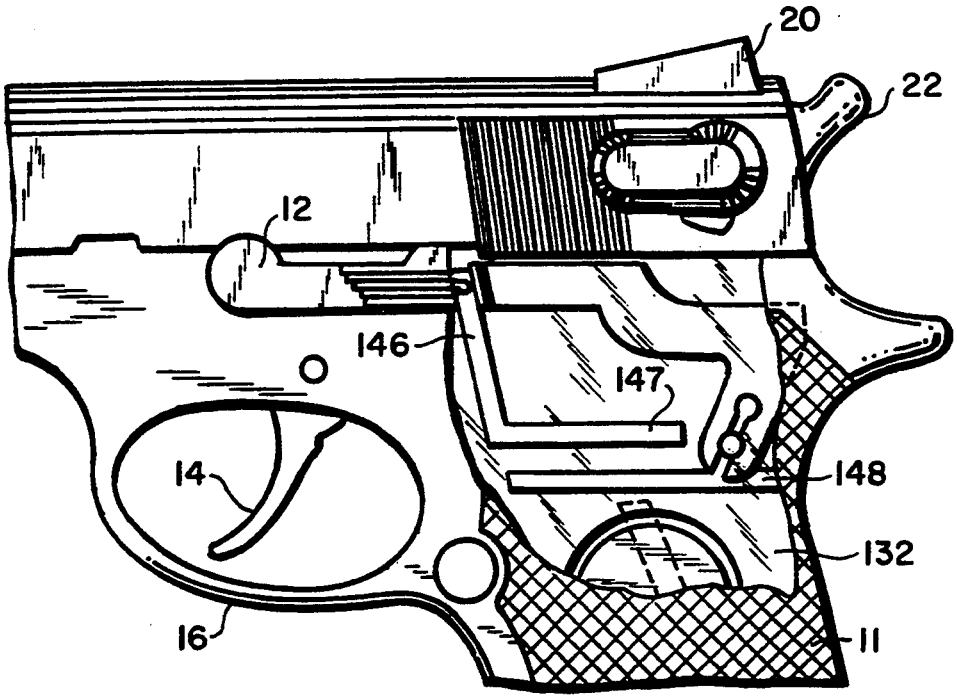
FIG. 2 is an enlarged plan view, partially cut away, of the left side of the upper rear portion of the gun of FIG. 1.
Figure 3:
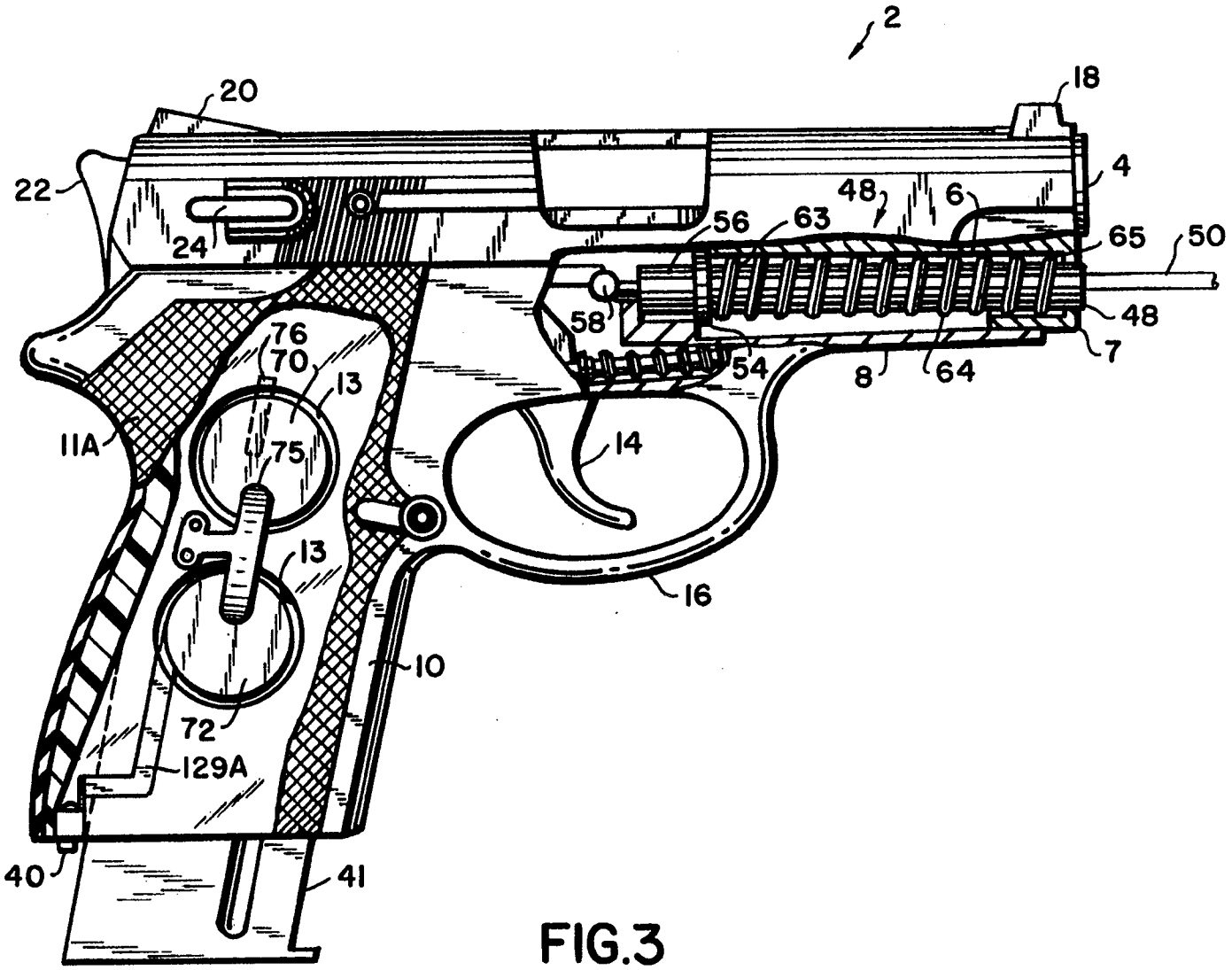
FIG. 3 is a right side plan view partially cut away of the gun of FIG. 1 showing the location of some of the laser sight components in the gun.

A semi-automatic handgun incorporating the internally mounted laser sight of the present invention is shown in the accompanying drawings. The specific type of pistol shown is a modified Smith and Wesson Semi-Automatic 40 Caliber Handgun.

The gun is indicated generally at 2 and includes a barrel 4, recoil spring guide channel 6, main frame 8, handle frame 10 and handle covers 11, slide stop 12, and trigger 14. The trigger guard 16 is incorporated integrally with the main frame 8.

Gun 2 is provided with the usual mechanical sights; i.e. front sight 18 and rear sight 20, hammer 22 and safety 24.

The laser beam emanating from the front of the recoil spring guide portion of the gun 2 is indicated at 50. The body of the laser sight is indicated generally at 48, replacing the usual recoil spring guide.

The laser sight body 48 includes the forward shaft section 52 which is threadably connected to the rear section 56. Rear section 56 carries shoulder 54, against which the rear 63 of the recoil spring 64 rests. Front end 65 of the recoil spring 64 bears against the flange 7 at the front of the recoil spring guide channel 6.

The internal structure of the laser body 48 is shown best in FIGS. 5, 6, 7 and 8. The front section 98 of the forward shaft section 52 has a recess 99 with annular threads 100 which match threads 103 on the lens ring 101. The lens cover 102 and retains the collimating lens 106 in place.

Figure 5:
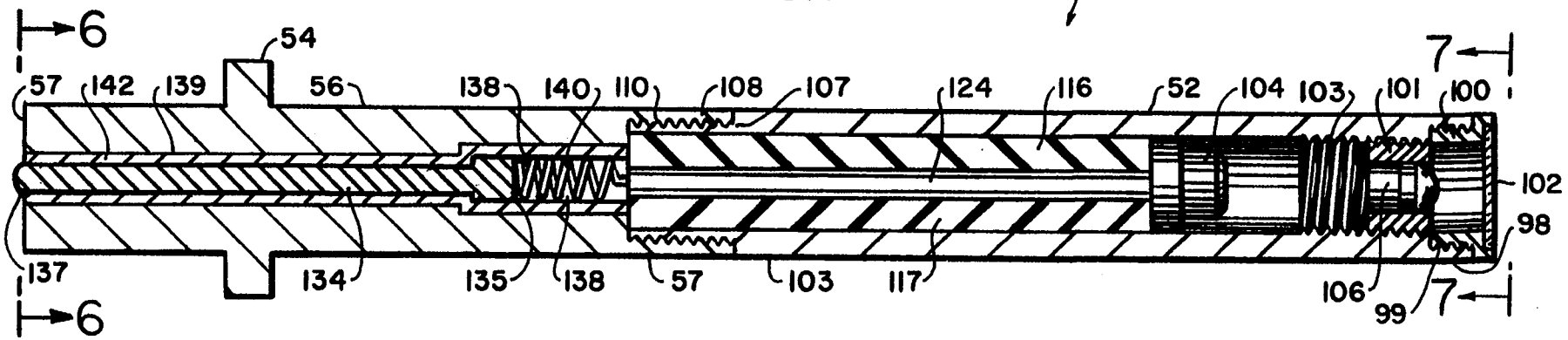
FIG. 5 is a longitudinal sectional view of the laser sight assembly.
Figure 7:
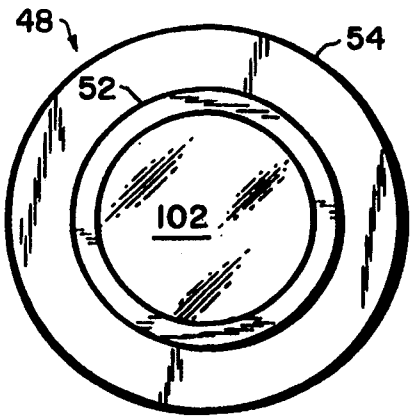
FIG. 7 is an end view along line 7—7 of FIG. 5.
Figure 6:
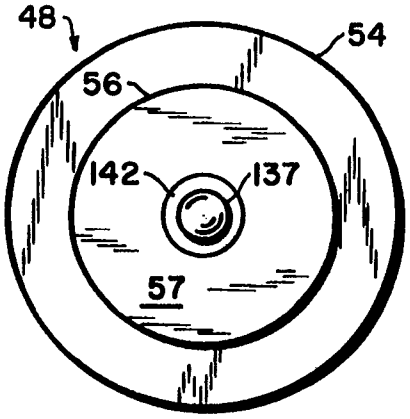
FIG. 6 is an end view along lines 6—6 of FIG. 5.
Figure 8:
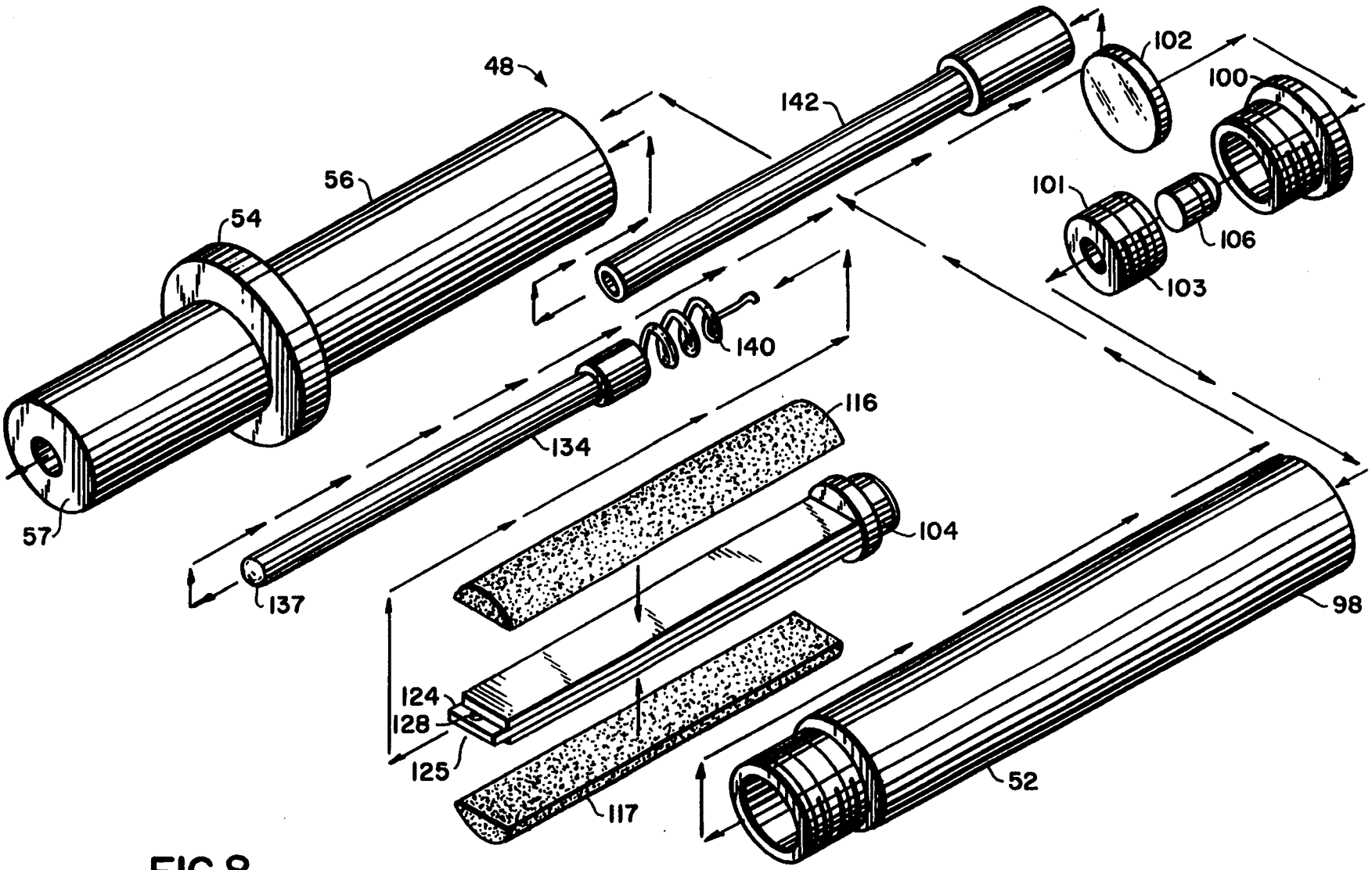
FIG. 8 is an exploded perspective view of the sight components shown in FIG. 5.

The shaft section 52 has an inset portion 107 at the rear end 103 thereof with threads 108 thereon which mate to internal threads 110 of the forward end of the rear shaft section 56 shown best in FIGS. 5 and 8. The diode 104 is retained in the recess by retainer ring 101. The diode 104 in turn is connected to the circuit board 124 which is sandwiched between the padded insulation layers 116 and 117.

The rear 125 of the circuit board 124 has an aperture 128 therein for retaining the spring 140 which is carried in the longitudinal chamber 138 of the base portion 56 and bears against the end 135 of conductive shaft 134 in longitudinal opening 139 of the rear section 56. A non-conductive sheath 142 isolates shaft 134 from section 56.

Figure 9:
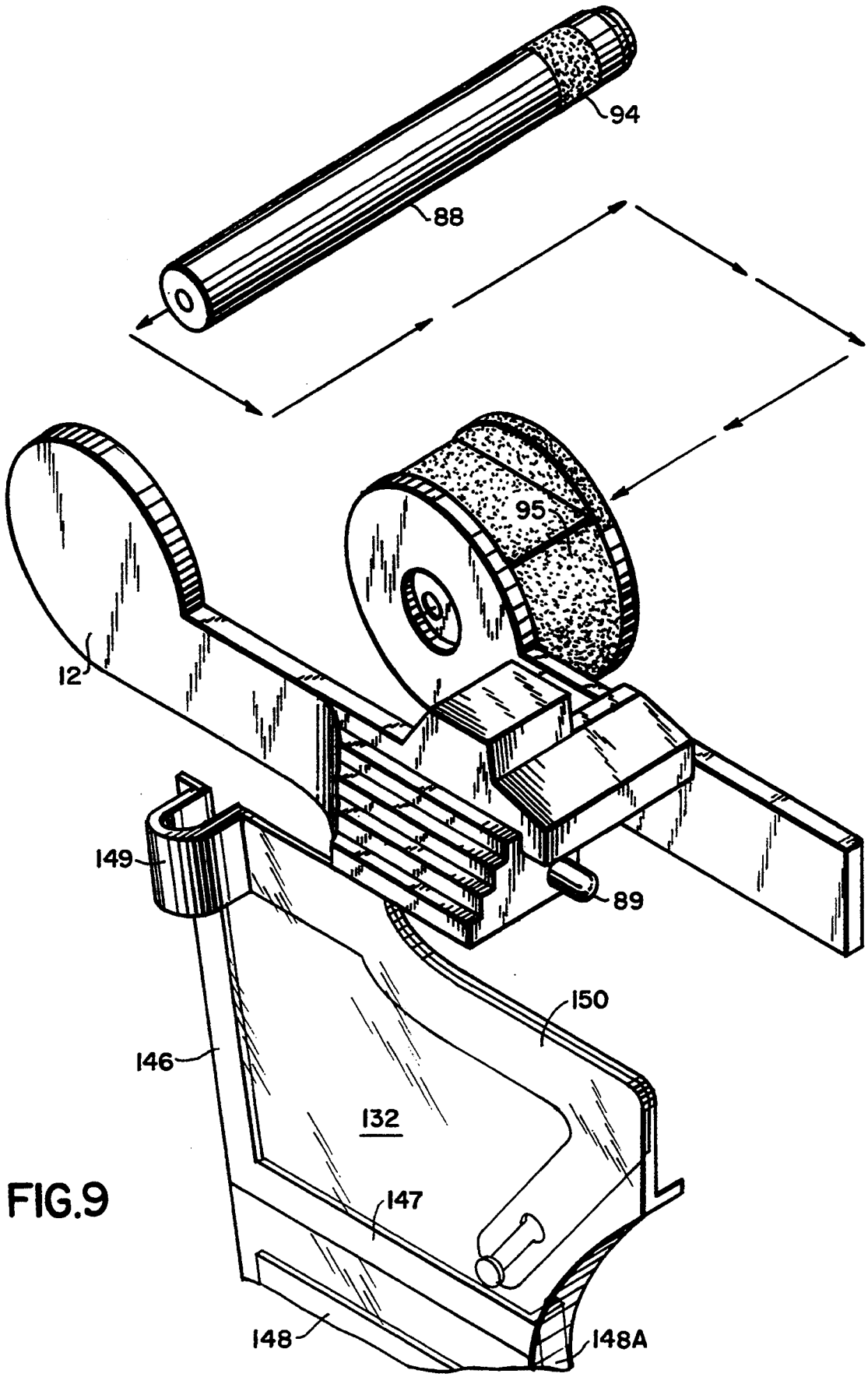
FIG. 9 is a perspective view of the components of the laser sight system and its electric circuit.

The other end 137, of shaft 134 extends slightly beyond the end 57 of section 56 in conductive contact with the cross piece 88 of the slide stop 12. The piece 88 and slide stop 12 are shown best in FIGS. 9 and 10.

The piece 88 which is journaled in openings in the gun frame 8 is covered with non-conductive coatings 94 and 95 where it contacts the gun body to isolate it from conductive contact with the frame 8 of the gun 2.

Thus the rear 137 of the conductive rod 134 is in contact with the cross shaft 88 which is electrically isolated from the frame 8 of the gun 2 by the nonconductive coatings 94 and 95.

The shaft 88 is conductively connected to the slide stop 12 and slide stop plunger 89.

Figure 4:
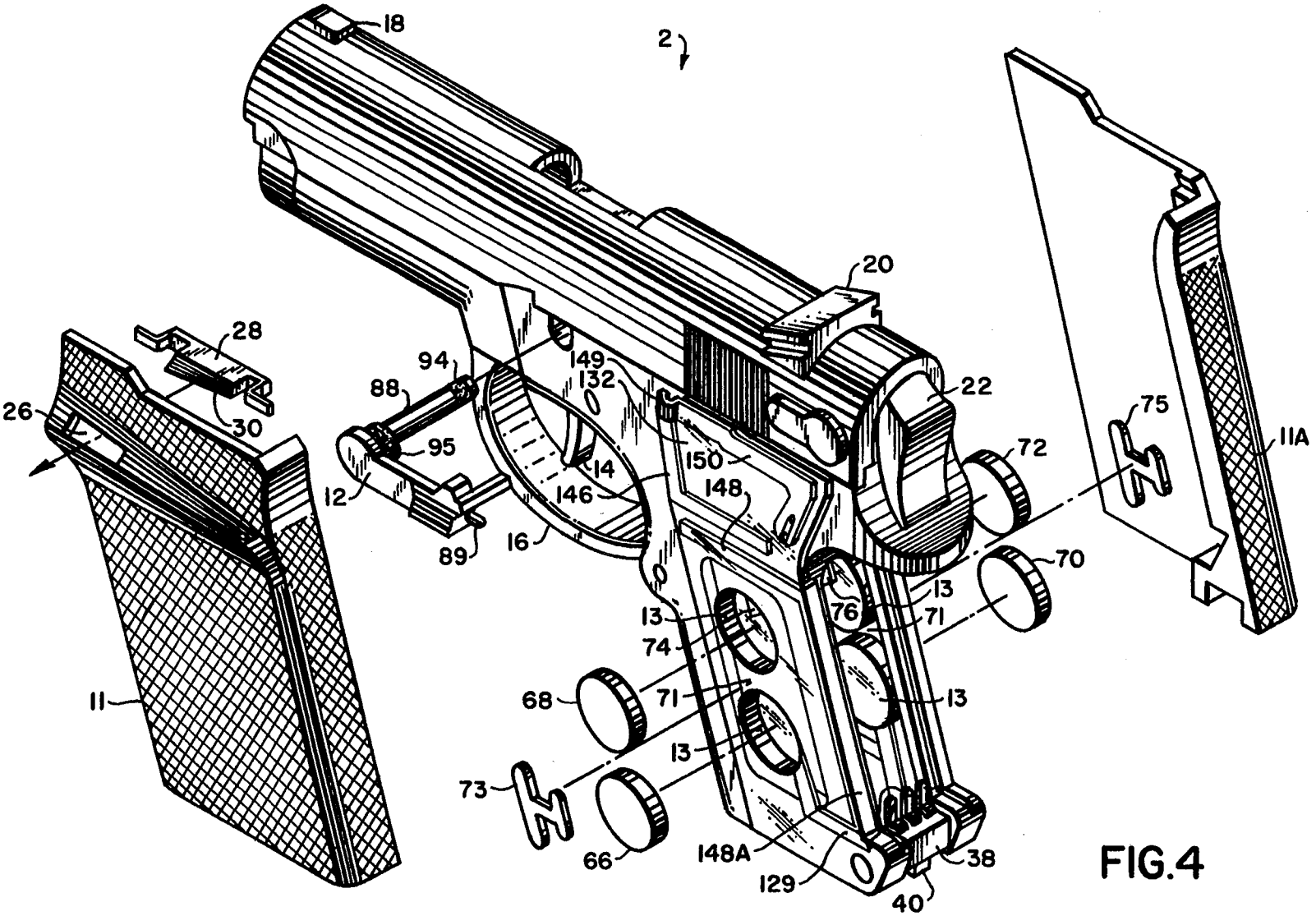
FIG. 4 is an exploded view of the gun showing main parts of the gun and major components of laser sight system.

The slide stop plunger 89 is in conductive contact with the curved end 149 of the conductive strip 146 on the surface of plastic panel 132. The strip 146 extends slightly downward as shown as in FIGS. 4 and 9, and 11 and then rearwardly. The rearward section 147 is separated slightly from a parallel strip 148. The strip 148 then extends downwardly and the lower end 148A is connected by wire 130 to common contact 46 on the switch 40.

In the left handle cover 11, an opening 26 is provided for the switch 28 push button 30. The inside face of button 30 is conductive and when pushed inwardly places the conductive strips 146 and 148 imbedded in the plastic panel 132 in conductive communication. The strip 146 extends to the upper corner 149 of the plastic panel 132 which is molded to conform to the shape of sideplate 150. The strip 146 terminates on the forward surface of the plate 132 and makes contact with the plunger 89 of the slide lock 12.

The panels 132 and 133 are placed between the non-conductive handle covers 11 and **11*a* and handle frame 8**.

Figure 10:
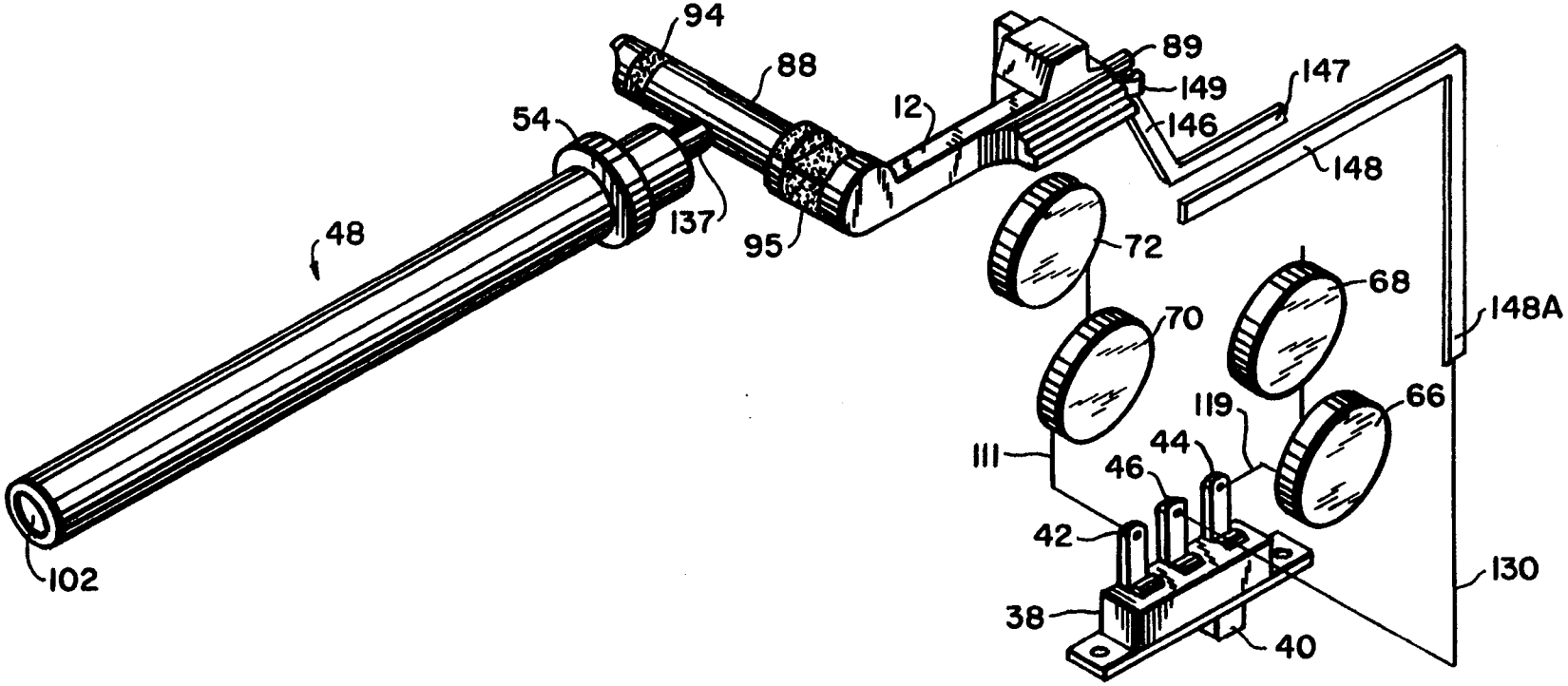
FIG. 10 is a perspective view of the three way on/off switch component of the electric circuit of the laser system.
Figure 13:
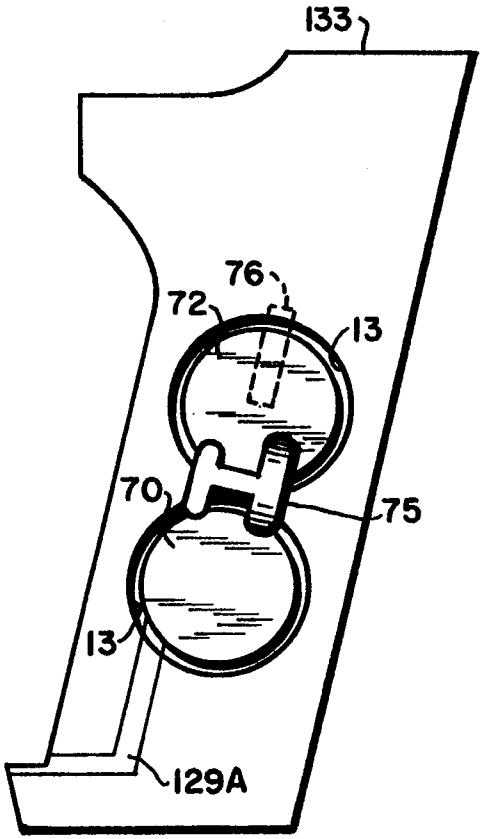
FIG. 13 is a plan view of the right hand batterie(s) retainer and circuit component.
Figure 12:
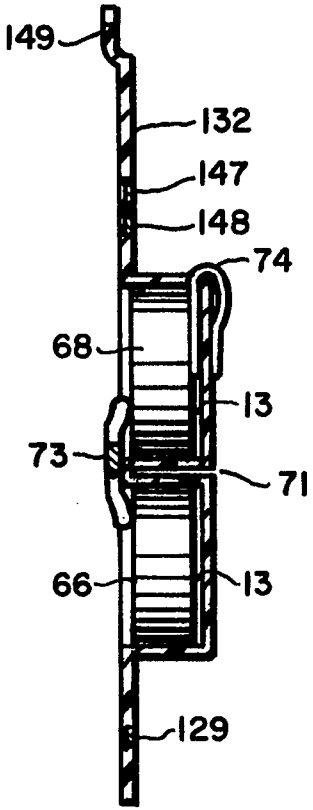
FIG. 12 is a view along lines 12—12 of FIG. 11.
Figure 11:
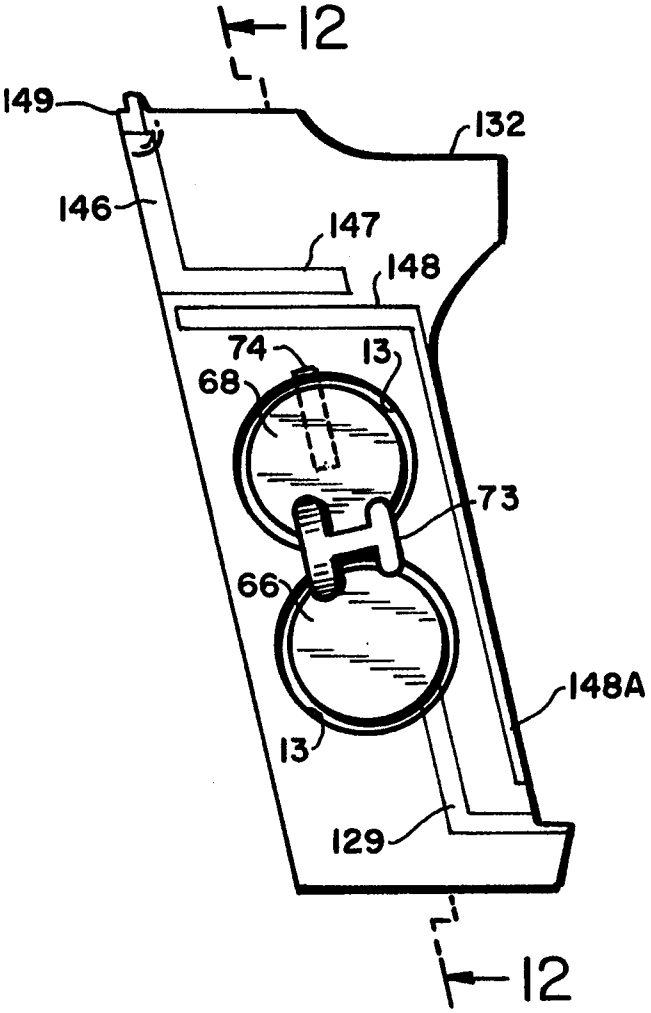
FIG. 11 is a plan view of a circuit component and left hand batterie(s) retainer.
Figure 14:
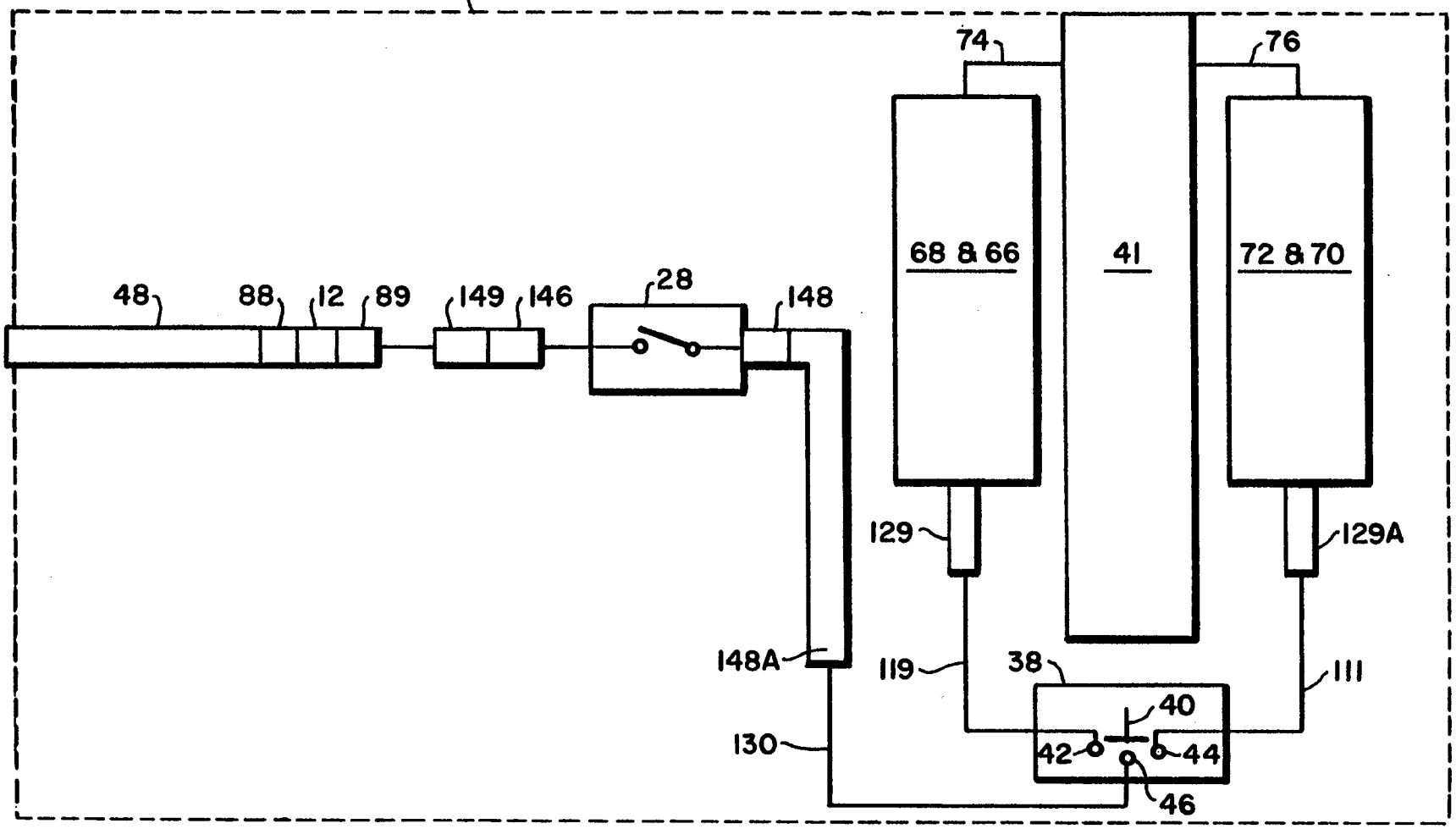
FIG. 14 is a schematic illustration of the electric circuit of the laser sight system in the handgun.

In FIG. 10, for illustrative purposes, the strips 146 and 148 and other circuit components are shown isolated from the plastic panel 132 which is shown in detail in FIGS. 11 and 12.

A contact switch 28 is secured in aperture 26 in the left side of the gun 2. It is spring biased off. When depressed, the button 30 of switch 28 completes a contact between the strips 146 and 148 and through to laser diode 104. The circuit is completed through frame 8 to magazine 41 in contact with the batteries through clips 74 and 76 which are embedded in the plastic panel 132.

The batteries 66 and 68 are joined by clip 73 and batteries 70 and 72 by clip 75. The batteries rest in wells 13 in the panels 132 and 133 separated by partition 71.

The conductive strip 148A continues downwardly to the base of the plate 132 and connected to contact 146 on the switch 40 by wire 130.

The pairs of batteries 66 and 68 and 70 and 72 are retained in the recesses 13 of the plastic plates 132 and 133 by the metallic spring retainer clip 73 and 75 which also completes the circuit between the batteries. The conductive strips 129 and **129*a* and wires 119 and 111 connect the batteries to the switch 40. Connecting brackets 73 and 75 connect the batteries conductively in pairs 66–68 and 70–72** respectively.

Wire 119 is connected to the contact 44 on the switch 40. The contact 42 is secured to the other set of batteries through wire 111 and strip 129A on plastic panel 133 and the contact 46 is connected to laser circuit through wire 130, strip **148*a*, 148, switch 28, strip 146 through contact 149, slide stop pin 89, slide stop 12, cross piece 88, and the contact 137 at the end of conductive rod 134, rod 134, spring 140 and then to the circuit board 124**.

The current is supplied from batteries 66 and 68 when the switch 40 is in contact 42–46 position and batteries 70 and 72 when switch 40 is in contact 44–46 position, in the middle position it is off. As mentioned above, the circuit is completed through the gun frame 8 when the magazine 41 is in the gun 2.

A complementary plastic plate 133 is used on the right side to hold and connect batteries 70 and 72 to the switch 40.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A semiautomatic gun having a gun frame, a barrel, a handle having a base, a removable metallic magazine in said handle, a slide stop and an internally mounted laser sight system, wherein a circuit board, diode and collimating lens for said laser sight are all contained within a cylindrical shaft, said shaft having a forward end and a rearward end portion, and a longitudinal axis, which said shaft also serves as the recoil spring guide for said gun, said diode and said collimating lens being located at said forward end of said shaft, and said lens collimating a beam of light from said diode along said longitudinal axis of said cylindrical shaft and parallel to the barrel of said gun, electrical power for said circuit board being supplied through a conductive rod running along said longitudinal axis of said rearward end portion of said shaft and through said gun slide stop which is conductively isolated from said gun frame, and conductive strips mounted on a non-conductive plastic panel in a first side of said gun handle, said strips in conductive communication with first switch means in said base of said gun handle, said first switch means controlling current from one of at least two sets of batteries mounted in opposed sides of said handler conductive means between said sets of batteries and said metallic magazine carried in said handle of said gun to complete an electrical circuit when said magazine is in said handle and interrupt said circuit when said magazine is removed from said handle.

2. A gun as claimed in claim 1 wherein second switch means are mounted on said handle to interrupt or complete said circuit by press button means.

3. A semiautomatic gun having a gun frame, a barrel, a handle having a base, a removable metallic magazine in said handle, a slide stop and an internally mounted laser sight system, wherein a circuit board, diode and collimating lens for said laser sight are all contained within a cylindrical shaft, said shaft having a forward end and a rearward end portion and a longitudinal axis which said shaft also serves as the recoil spring guide for said gun, said diode and said collimating lens being located at said forward end of said shaft, and said lens collimating a beam of light from said diode along said longitudinal axis of said cylindrical shaft and parallel to the barrel of said gun, electrical power for said circuit board being supplied through a conductive rod running along said longitudinal axis of said rearward end portion of said shaft and through said gun slide stop which is conductively isolated from said gun frame, and conductive strips mounted on a non-conductive plastic panel in a first side of said gun handle, said strips in conductive communication with switch means in said base of said gun handle, said switch means controlling current from at least one battery mounted in said handle, and said metallic magazine carried in said handle of said gun to complete an electrical circuit when said magazine is in said handle and interrupt said circuit when said magazine is removed from said handle.

* * * * *